United States Patent [19]

Robichaud et al.

[11] Patent Number: 4,934,590

[45] Date of Patent: Jun. 19, 1990

[54] PACKAGE CLOSURE

[75] Inventors: Arthur W. Robichaud, Worthington, Ohio; Charles D. Miller, Rockford, Ill.; Frank R. Wilgus, Powell, Ohio

[73] Assignee: Combibloc, Inc., Columbus, Ohio

[21] Appl. No.: 353,052

[22] Filed: May 17, 1989

Related U.S. Application Data

[63] Continuation-in-part of Ser. No. 315,601, Feb. 27, 1989, Pat. No. 4,915,290.

[51] Int. Cl.[5] ..... B65D 5/74

[52] U.S. Cl. ..... 229/125.09; 220/334; 229/125.14

[58] Field of Search ..... 229/125.08, 125.09, 229/125.13, 125.14, 125.15, 125.17; 220/260, 268, 269, 335, 375, 334

[56] References Cited

U.S. PATENT DOCUMENTS

| | | | |
|---|---|---|---|
| 2,826,348 | 3/1958 | Schroeder et al. | 229/125.09 |
| 2,885,084 | 5/1959 | Rocca | 229/125.09 |
| 2,889,976 | 6/1959 | Van Canfort | 229/125.13 |
| 3,018,024 | 1/1962 | Foord | 229/125.09 |
| 3,952,914 | 4/1976 | Vogt | 220/335 |
| 4,732,315 | 3/1988 | Gunn | 229/125.09 |
| 4,771,936 | 9/1988 | Dolby | 229/125.08 |

FOREIGN PATENT DOCUMENTS

3832412 A1 4/1989 Fed. Rep. of Germany .

*Primary Examiner*—Gary Elkins

*Attorney, Agent, or Firm*—Porter, Wright, Morris & Arthur

[57] ABSTRACT

A closure for opening and reclosing a package includes a base attachable to the top of the package over a scored area thereof, and a lever pivotally connected to the base at a rearward portion of the base so that by pivoting the lever, a portion of the lever penetrates the scored area of the package, and eventually, another portion of the lever seats over the open area of the package to provide a pouring spout. A removable cover is provided over the seating portion of the lever so that re-opening and resealing of the package occurs by removing the cover.

6 Claims, 5 Drawing Sheets

FIG. 12
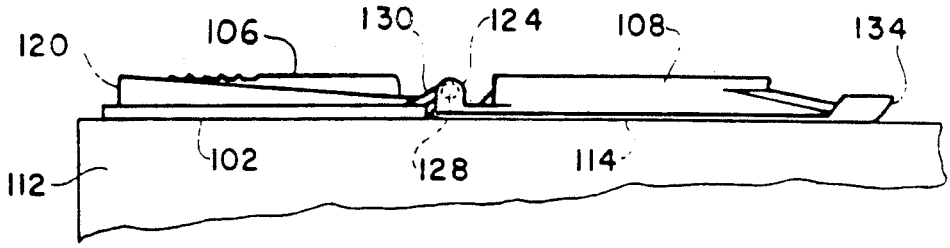
FIG. 13
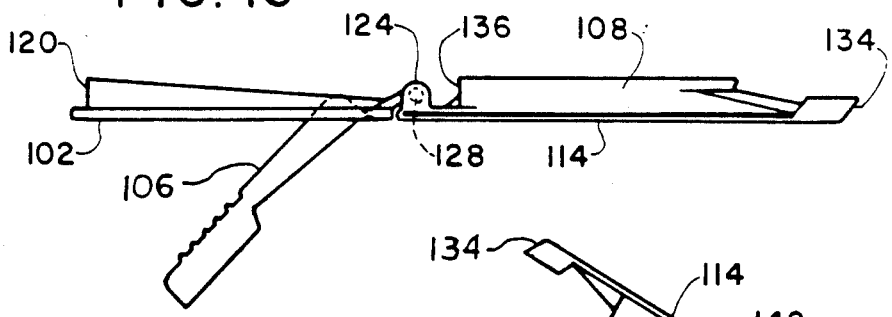
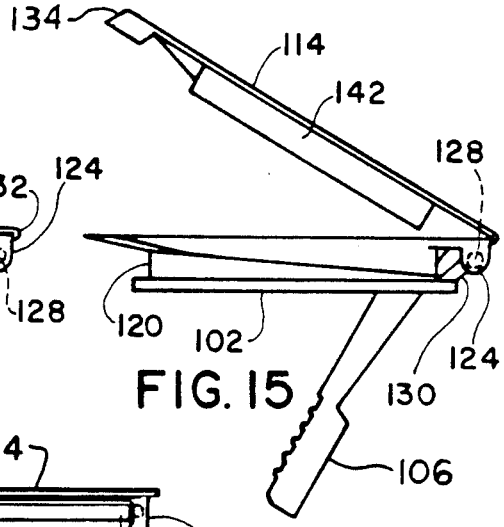
FIG. 14
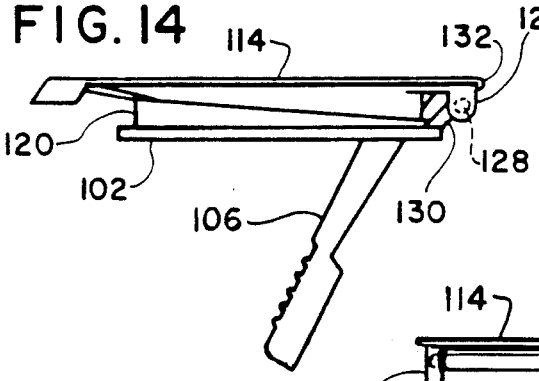
FIG. 15
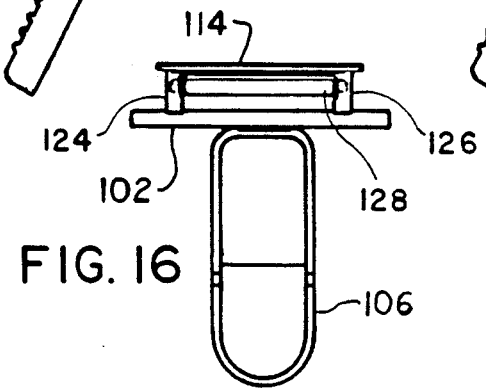
FIG. 16

PACKAGE CLOSURE

BACKGROUND OF THE INVENTION

This is a Continuation-in-Part of U.S. Ser. No., 315,601 filed Feb. 27, 1989, now U.S. Pat. No. 4,915,290 issued 4/10/90.

1. Field of the Invention

The present invention relates generally to packages and containers for liquids and, more specifically, to closures having package opening and resealing features.

2. Description of the Related Art

Paperboard cartons for beverages are generally well known. Probably the most familiar type is the milk carton which is provided with a gabled top, one end of which is designed to be folded back and then forwardly to provide a pouring spout. After use, the pouring spout is then folded back again to close the carton.

Separately attachable closures provide an alternative means of opening and resealing a package. Generally, a box-like package having a flat top is provided with a scored area which can be broken inwardly to open the package. A closure is fitted over the scored area so that after opening, the package can be resealed to maintain the freshness of the contents thereof.

European Patent Application No. 0 291 112 A2 describes a closure which is attached to the top lid of a container. The device includes a base portion and a movable portion preferably hinged thereto. The base portion has a dispensing aperture, a depending flange encircling the aperture and a deformable pouring lip/-drain surface. The device is designed to be attached by pushing the base portions depending flange through a pre-scored or pre-cut aperture in the container's top. Thus, the closure of the aforementioned European patent application is not attached to the package prior to opening.

U.S. Pat. No. 4,247,014 to Walz describes a self-contained opener for hollow containers such as thin walled beverage cans. The apparatus provides a can cover including a flat portion and a pull tap respectively having first and second mating portions mutually fixed and permanently interconnected, located either fixedly in the cover or together rotatable with the flat portion inwardly of the can as it is opened. The pull tab has an annular end portion encircling the opening formed by breaking open the flat portion, and covers the raw edge of the opening in its final protective position. Due to the fact that the container is a metal can, the pull tab is riveted to approximately the center of the top of the can.

U.S. Pat. No. 3,977,561 to Strobe et al. describes a pull tab which is rotated nearly 180° to seat over an opening left by a tear tab which is pushed inwardly and to the side of the beverage can. The pull tab has a central opening for dispensing liquid.

U.S. Pat. No. 4,629,088 to Durgin describes a beverage container lid including a foldable flap which may be opened to allow a user to drink from a beverage container which is covered by the lid. A recess in the beverage container lid is provided to receive the open flap and to firmly secure the flap in its open position. The recess includes a pair of detents on either side and an overhang at one end which cooperate to hold the flap firmly within the recess.

The aforementioned references do not satisfactorily provide opening and resealing and pouring features suitable for flat top packages, particularly paperboard packages of the aseptic type.

A continuing need exists for closures which are inexpensive to manufacture but effective in resealing the contents of the package. Moreover, a need exists for improved means for opening paperboard containers without tearing or folding or otherwise altering the basic geometric configuration of the container.

SUMMARY OF THE INVENTION

An object of the present invention is to provide a closure which is capable of opening a package and then reclosing the package after opening.

Another object of the present invention is to provide a closure which can be easily attached to a paperboard package without protruding from the package in such a way as to change the outward geometry of the package.

Yet another object of the present invention is to provide a closure which is made substantially as a one piece molded plastic unit attachable to a package prior to opening.

Still another object of the present invention is to provide a closure having a built-in spout which facilitates pouring of the contents of a package after opening.

Another object of the present invention is to provide a package closure which is relatively simple in construction and cost effective to produce.

In a preferred embodiment, a closure for opening and reclosing a package includes a base attachable to the top of the package over a scored area and having a rearward portion and a forward portion juxtaposed a pouring edge of the top, and a central open area extending longitudinally between the rearward portion and the forward portion, and a substantially rigid lever pivotally connected to the rearward portion of the base and having a forward portion and a rearward portion, the forward portion being disposed over the central open area of the base prior to opening the package and being pivotally movable through the central open area to open the package, the rearward portion being movable into a seated position over the central open area of the base after opening the package. Preferably, the rearward portion of the lever includes a central opening through which the contents of the package are poured and which overlies the central open area of the base when the lever is rotated into the package-opening position. A spout is formed around at least a forward peripheral edge of the central opening and a hinged cover is fitted over the central opening of the rear portion of the lever so that after initial opening in which the scored area is broken, the package is reopened and resealed by opening and reclosing the cover.

These objects, together with other objects and advantages which will be subsequently apparent reside in the details of construction and operation of the resealable package closure as more fully hereinafter described and claimed, reference being had to the accompanying drawings forming a part hereof, wherein like reference numerals refer to like parts throughout.

BRIEF DESCRIPTION OF THE DRAWINGS

FIGS. 12–15 are side elevational views of the embodiment of FIG. 10, showing sequential opening steps; and FIG. 16 is a near view of the closure of FIG. 10.

DETAILED DESCRIPTION OF THE PREFERRED EMBODIMENTS

Figure 1:
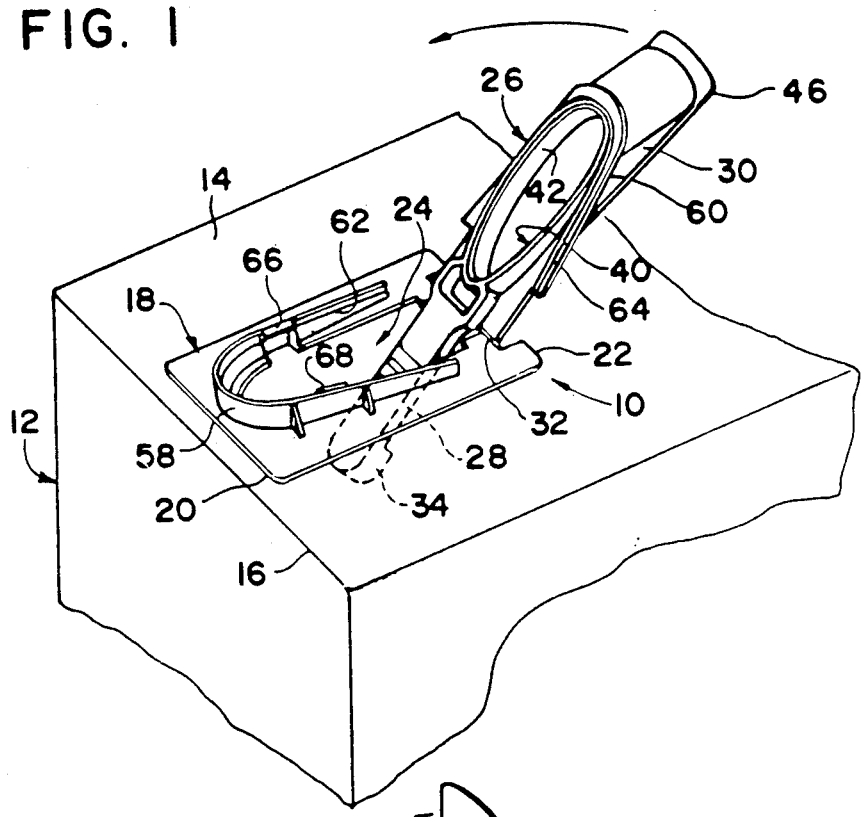
FIG. 1 is a perspective view of a closure attached to the top of a package according to a first preferred embodiment of the present invention.

Referring now to FIGS. 1–5, a closure for opening and resealing a package is generally referred to by the numeral 10. The closure 10 is attachable to a box-like paperboard package 12 which contains a dispensable fluid. The top 14 of the package 12 is provided with a scored or partially cut area over which the closure 10 is attached. The scored area is the area defined by a score line or partially cut line which is preferably U-shaped. The U-shaped score line and thus the closure 10 are located near a pouring-side edge 16 of the top 14.

The closure 10 has a base 18 which is attachable to the top 14 of the package 12 by any suitable means, such as adhesive bonding. The base 18 has a forward portion 20 and a rearward portion 22. The forward portion 20 is juxtaposed the edge 16 of the top 14. A central open area 24 opens from the rearward portion 22 and extends longitudinally towards the forward portion 20. The central open area 24 is substantially U-shaped and corresponds to the U-shaped scored area of the top 14.

A substantially rigid lever 26 is pivotally connected to the rearward portion 22 of the base 18 and has a forward portion 28 and a rearward portion 30. The forward and rearward portions are divided at approximately a transverse center line of the lever 26, the transverse center line providing a pivot axis. The forward portion 28 of the lever 26 is disposed over the central open area 24 of the base 18 prior to opening the package 12.

Since the closure 10 is preferably molded out of plastic materials, the lever 26 and the base 18 can be made as a one-piece unit. A score line 32, which may be formed by stamping, partial cutting, or as a molded depression, is provided between the forward and rearward portions of the lever to act as a hinge and fulcrum for the lever 26 when it rotates through its range of pivotal movement. The forward portion 28 of the lever 26 is elevated slightly from the lower part of the rearward portion 30. Also, the forward portion 28 is more narrow than the rearward portion so as to facilitate movement of the forward portion through the central open area 24 of the base 18. A blunt stiffening flange 34 formed on the end of the lever 26 stiffens the lever at the end and impinges on the scored area of the top 14 during rotation of the lever and pushes a flap defined by the score line of the top inwardly and backwardly into the package 12.

Figure 3:
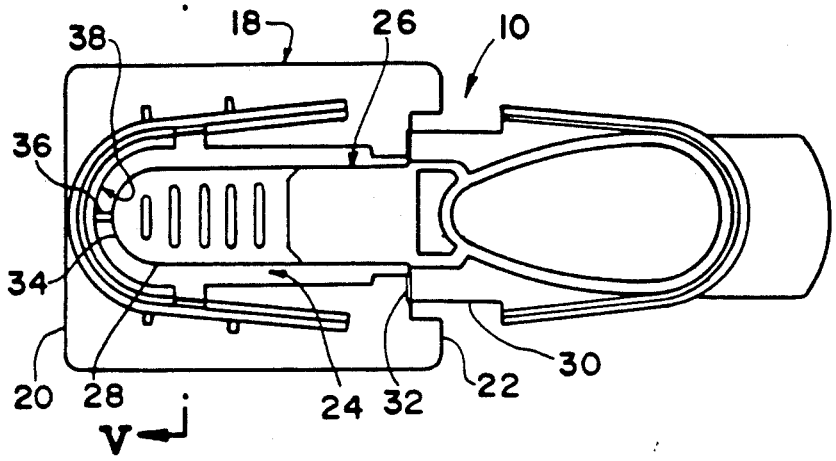
FIG. 3 is a top view of the closure of FIG. 1.
Figure 4:
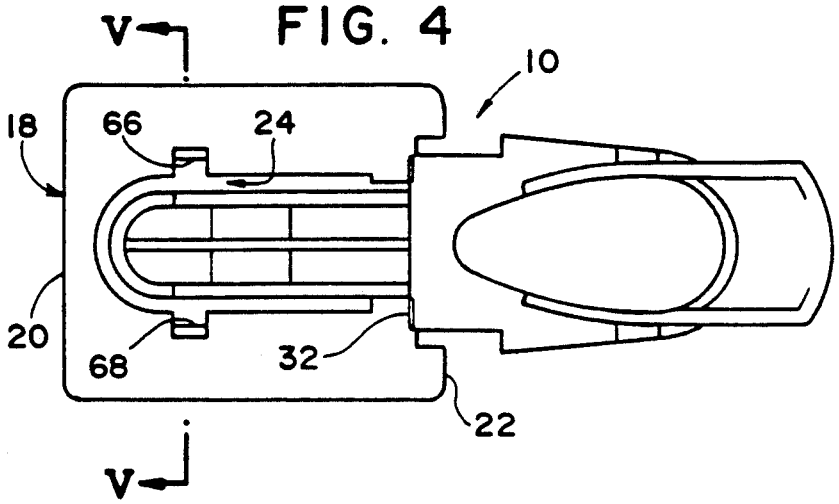
FIG. 4 is a bottom view of the closure of FIG. 1.
Figure 5:
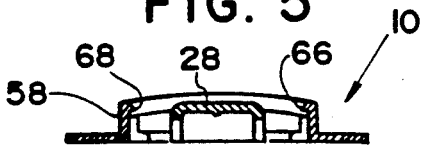
FIG. 5 is a cross-sectional view taken along line V—V of FIG. 3.

FIGS. 3 and 4 show the lever 26 in its flat, preopened disposition. The closure 10 substantially conforms to the top of the container 12 prior to opening the container and thus does not interrupt the overall box-like geometry of the package. This feature is important in that it allows the packages to be stacked in an orderly manner on grocery shelves, etc. Thus, prior to opening, the closure 10 has an overall flat appearance. A frangible connection 36 is provided between the stiffening flange 34 of the lever 26 and the curved edge 38 of the central open area 24. The connection serves to hold the lever in its flat, preopen position shown in FIG. 6, and comprises a small piece of plastic material integrally formed with and extending between the base and lever. Sufficient downward motion of the lever fractures the connection to permit the lever to move as described above. The fracture also evidences tampering, since the package cannot be operated without fracturing the connection.

Figure 2:
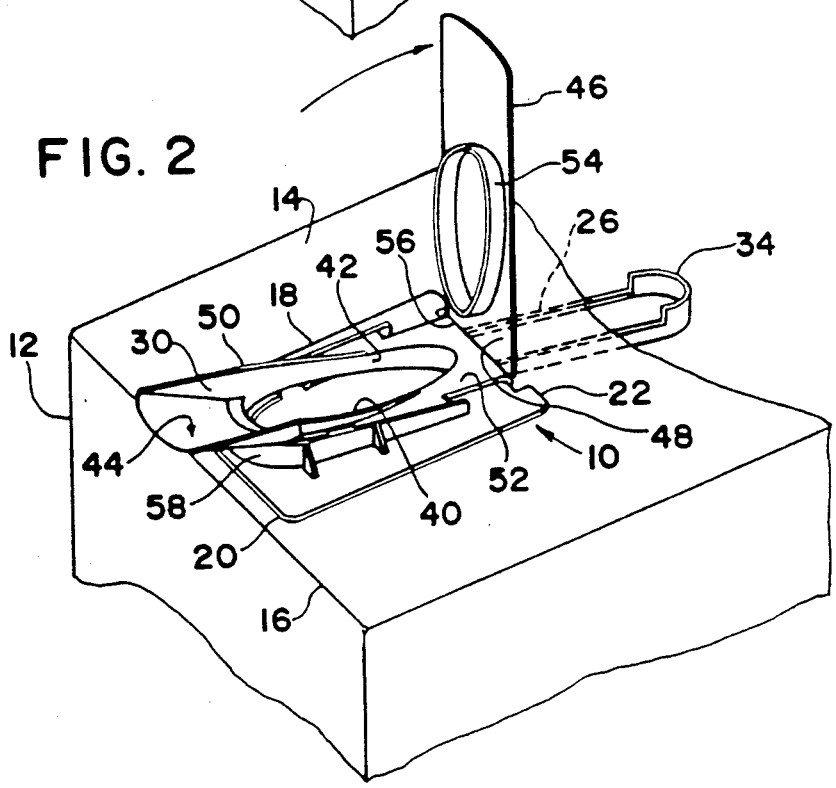
FIG. 2 is a perspective view of the closure of FIG. 1, with a lever of the closure rotated to the package-open position, and with a cover of the closure rotated open from a pouring opening provided in the lever.

To open the package 12, the forward portion 28 or the lever 26 is pushed downward while the rearward portion 30 is lifted upwardly, thus initially breaking the frangible connection 36 and pivoting the lever 26 about the score line and pivot axis 32. The lever 26 rotates nearly 180° until the rearward portion 30 is in a seated position over the central opening 24 of the base 18, as illustrated in FIG. 2. The rearward portion 30 of the lever 26 includes a central opening 40 formed by an upstanding curved sidewall 42. A spout 44 is formed around at least a forward portion of the peripheral edge of the central opening 40. A hinged cover 46 has an inner planar surface 48 which overlies the rearward portion 30 of the lever and is in continuous contact with the raised edge 50 which extends around the central opening 40. The raised edge 50 is coplanar with a flat portion 52 of the lever 26. Thus, when the cover 46 is fitted on the rearward portion 30, the inner planar surface 48 closes the opening 40 by maintaining an abutting, coplanar relationship with the raised edge 50 and flat portion 52.

The hinged cover 46 is also provided with a raised lip 54 on the inner planar surface 48. The lip 54 has a shape corresponding to the shape of the central opening 40. The outer surfaces of the raised lip 54 provide an interference fit with the curved sidewall 42 of the opening 40 so as to hold the cover 46 in place. The rearward end 56 of the cover 46 may be hinged to the rearward portion of the lever 26 so that, after rotating the lever nearly 180° to open the container, the cover 46 may be pivoted in a direction opposite of the original pivotal movement of the lever to provide a reclosing capability. When manufacturing the closure out of molded plastic, the lever 26, the base 18, and the cover 46 are molded together, with the cover molded at an angle to the base and lever which are molded in-line. A hinged connection is provided between the rearward end 56 of the cover 46 and the rearward portion 30 of the lever 26 by a hinge comprising part of the molded plastic material. The cover can not be completely separated from the lever when re-opening the package. However, it would be possible to mold the cover separately and detachably connect it to the lever.

After the lever 26 is rotated nearly 180° to the open position, the rearward portion 30 is fitted into the base 18 and is held in place by complementary fastener means. In a preferred embodiment, the complimentary fastener means includes a substantially U-shaped lip 58 whose inner edge corresponds substantially to a U-shaped outer edge 60 of the rearward portion 30. Thus, when the rearward portion 30 is rotated into a position over the central open area 24, further rotation causes the lever and the base to be locked together by an interference fit between the outer edge 60 and the inner edge of lip 58. Alternatively, or in addition thereto, complimentary locking tabs may be provided on the cover for locking in receptacles provided in the lever.

Complimentary sealing means may also be provided between the lip 58 and the rearward portion 30 by providing a slight downward groove 62 along the inner wall of the lip 58, and a slight protrusion 64 provided around the rearward portion 30. The interference fit between the lip 58 and the rearward portion 30 insures an adequate seal between the two components such that when the package is tilted for pouring, the liquid will flow out of the central opening 40 (after removal of the cover 46) and will be directed away from the edge 16 of the top 14 by the spout 44, thus preventing dripping.

Additional locking means are provided to maintain the seating of the rearward portion 30 in the lip 58. Locking arms 66 and 68 are provided on opposite sides of the lip 58 and are positioned to engage the U-shaped outer edge 60 of the rearward portion 30 after the edge 60 is pressed below the lower ends of the locking arms, thus providing one-way locking means. Alternatively, a single locking arm can be provided on the forward portion of the base for locking with a receptacle or other complementary means provided on the lever.

Referring now to FIGS. 6–9, operation of the closure 10 will be described with reference to the range of rotational movement of the lever (note that FIGS. 6–9 are views taken from a side opposite the views of FIGS. 1 and 2, so that the scored area to be opened appears on the left side in FIGS. 1 and 2, and on the right side in FIGS. 6–9).

Figure 6:
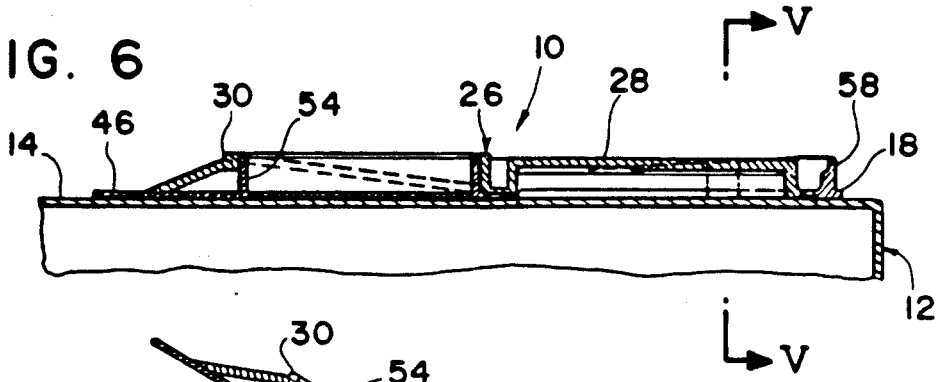
FIGS. 6–9 are side elevational views, partly in section, showing the range of rotational movement of the closure of FIG. 1 and the package opening and resealing features thereof.
Figure 7:
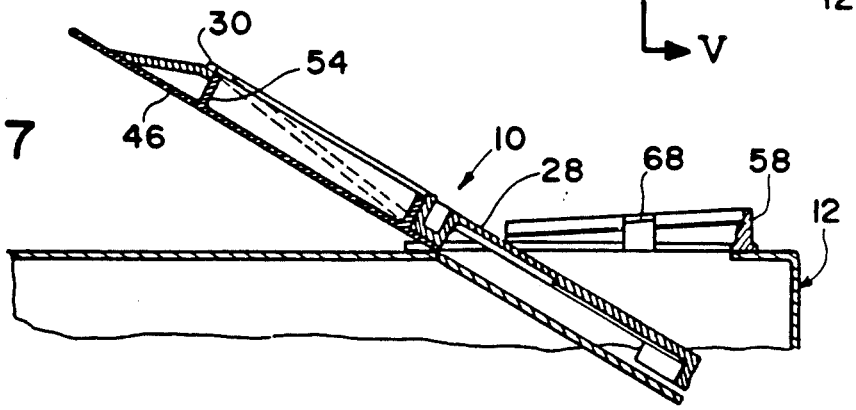
Figure 8:
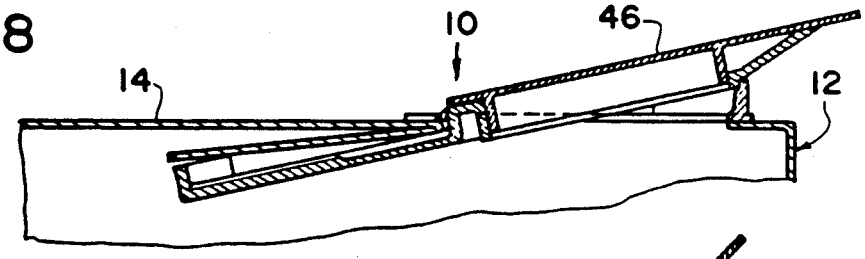
Figure 9:
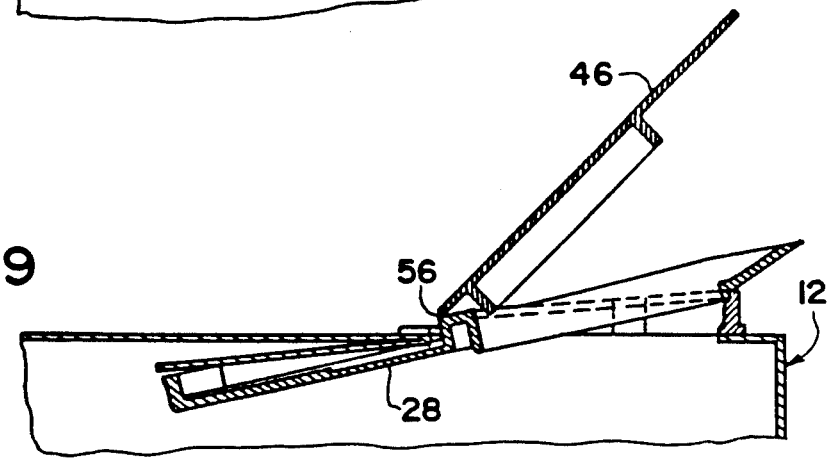
Figure 10:
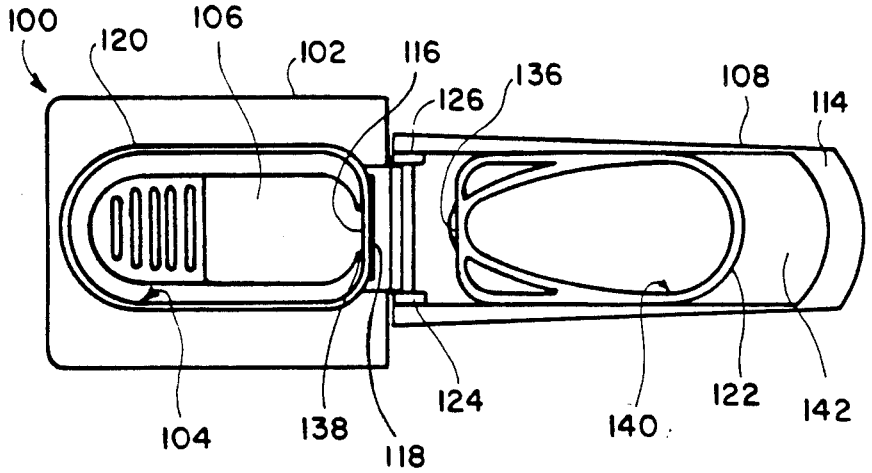
FIG. 10 is a top plan view of a second, preferred embodiment of a closure according to the present invention.
Figure 11:
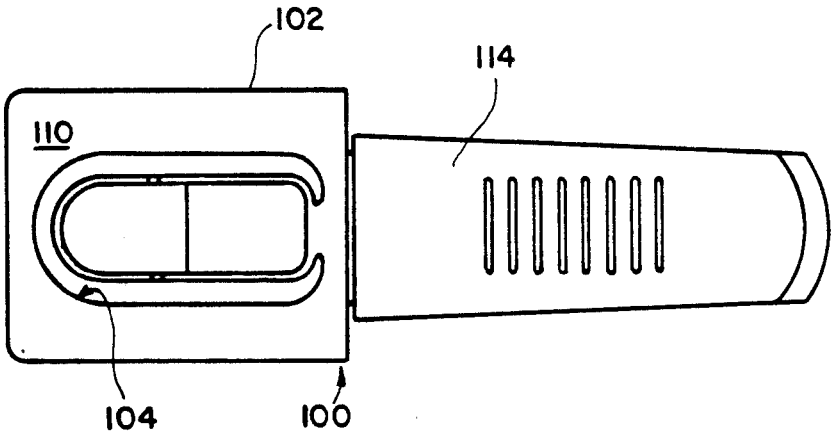
FIG. 11 is a bottom plan view of the closure of FIG. 10.

FIG. 6 shows the closure 10 and package 12 prior to opening, whereupon the closure 10 conforms substantially to the top 14 and thus does not interrupt the geometric configuration of the package. The base 18 is attached to the top 14 over the scored area. The scored area is defined by a score line or partial cut line which can be provided by any known scoring techniques. The purpose of scoring is to weaken the top 14 in an area designed to break inwardly and thus provide an opening into the package 12. The scoring of the top should not be to the point of compromising the aseptic nature of the package, and since the score line is preferably U-shaped, a flap will be formed and which will remain attached to the top. For some packages, after the flap formed by the scored area is broken inwardly, the package must be refrigerated to keep the contents thereof from spoiling. However, the opening must in addition be reclosed to preserve the quality of the liquid contained therein. When the forward portion 28 of the lever 26 rotates through the scored area of the top 14, the package 12 is open, as illustrated in FIG. 7. Further rotation by either pushing downwardly on the forward portion 28 or pulling upwardly on the rearward portion 30, or both, takes place until the lever 26 is rotated almost 180° into the position illustrated in FIG. 8. In this position, the lever 26 is locked into place by the locking arms and the interference fit between the rearward portion 30 and the lip 58. At this point, the package 12 is resealed by the closure 10. To dispense liquid from the package 12, the cover 46 is pulled out of its seated position as shown in FIG. 9. If the rearward end 56 is hinged to the lever 26, and pivoted upwardly away from the central opening of the rearward portion 30. If no hinged connection is provided for the cover, the cover can simply be temporarily removed and replaced after liquid is dispensed from the package 12.

In the alternative embodiment illustrated in FIGS. 10–16, a closure 100 is similar to the previously described embodiment, except that the base 102 completely circumscribes the opening 104, and two independently movable lower segments 106 and 108 are pivotally connected to the rearward portion of the base 102. This embodiment is made more "resealable" by virtue of the fact that the flat lower surface 110 of the base 102 provides a frame which completely circumscribes the second region in the top of the package 112. Thus, when the base is bonded to the container adjacent the pouring edge, the bonding agent is applied completely around the scored regions of the container, thereby providing a seal between the base 102 and the container.

The lever segment 106 and base 102 are preferably injection molded of suitable plastic material as one piece, with a thin plastic hinge connecting them together at the rearward end 116 of the lever segment 106 and the rearward edge 118 of the opening 104. Although this connection is preferred, other suitable pivotal connections can be substituted. However, the hinge should be formed below the rim 120 of the base 102 so that the rim 122 of the lever segment 108 can snapfit into the opening 104 when the closure is manipulated through its opening sequence steps, as will be described more fully below.

The lever segment 108 is provided with a pair of trunions 124 and 126 at one end on opposite sides thereof. The trunions mount a pivot shaft 108 which is formed on an elevated support 130 provided on the rearward end of the base 102. The lever segment 108 is injection molded as a single piece with a cover 114. A thin plastic hinge 132 provides the interconnection at juxtaposed ends of the cover and lever segment. Since the plastic material is resilient, the trunions 124 and 126 can be forced outwardly to receive the pivot shaft 128 therebetween.

The lever segment 108 has a scalloped portion 142 which forms a pouring spout in a manner similar to the embodiment of FIGS. 1–9.

The opening and resealing sequence will now be described with reference to FIGS. 12–16. In the unopened position of FIG. 12, the base 102 and cover 114 have lower surfaces which are co-linear with each other and mutually coplanar with the outer surface of the top 113 of the package 112. In order to initiate package opening, the lower segment 106 is pushed downwardly into the package 112 after breaking through the scored region of the top, as shown in FIG. 13.

Next, the lever segment 108 is lifted upwardly at the beveled forward edge 134 of the cover 114, and pivoted substantially 180° to the position illustrated in FIG. 14. In this position, the rim 122 of the lever segment 108 snap-fits into the opening 104 and detachably connects to the rim 120 of the lever segment 106. Preferably, the rearward edge 136 of the rim 122 abuts a sloped rearward edge 138 of the lever segment 106 in order to hold the lever segment 106 downwardly as shown in FIG. 14 to avoid obstructing liquid when pouring.

As shown in FIG. 15, the cover 114 is then lifted upwardly to expose the opening 140 formed in the lever segment 108. The rim 142 of the cover 114 fits into the opening 140 of the lever support 108 to provide a resealing feature, so as to resume the position of FIG. 14 after pouring.

The fit of the cover 114 to the lever segment 108 enables the package to be shaken when the cover is in the closed position without spilling the contents.

Preferably, the plastic used to make the lever segment 106 and base 102 is of a color that contrasts with the color of the plastic used to make the lever segment 108 and cover 114. This provides an additional point of novelty, in that instructions for opening the package can be "color coded". For example, the package instructions tell the user to "push the blue tab downwardly, and then lift the white tab upwardly and rotate until seated in the blue base, then lift the white cover". This has the advantage of making the closure more "user friendly" and thus more acceptable by consumers of products packaged therein.

The many features and advantages of the present invention are apparent from the detailed specification, and thus, it is intended by the appended claims to cover all such features and advantages of the resealable package closure, which fall within the true spirit and scope of the invention. Further, since numerous modifications and changes will readily occur to those skilled in the art based upon the disclosure herein, it is not desired to limit the invention to the exact construction and operation illustrated and described. Accordingly, all suitable modifications and equivalents may be resorted to falling within the scope and the spirit of the invention.

We claim:

1. A closure for opening and a package having a top which includes a scored area to be opened and a pouring edge, the closure comprising:

a base attachable to the tope of the package and having a forward end portion, a rearward end portion, a central opening overlaying the scored area of the package top when the base is attached thereto, the central opening of the base having a peripheral edge;

a first lever segment pivotally connected to the rearward portion of the base and being pivotal about a pivot axis and movable through the base opening and scored area of the package;

a second lever segment pivotally connected to the rearward portion of the base and being pivotal about a pivot axis substantially parallel to the pivot axis of the first lever segment and having an opening, the second lever segment being movable to a position wherein the opening of the second lever segment overlies the opening of the base; and a cover movable between open and closed position over the openings of the base and second lever segment.

2. A closure according to claims 1, further comprising means for locking the base and the second lever segment together.

3. A closure according to claim 2, wherein the means comprises a rim formed around the opening of the base and a complementary, interfitting rim formed around the opening of the scored lever segment.

4. A closure according to claim 3, wherein the base circumscribes the second area of the package top.

5. A closure according to claim 1, wherein the first and second lever segments have contrasting colors.

6. A closure according to claim 6, wherein the base includes a pivot shaft formed at the rearward portion thereof, and the second lever portion includes a pair of trunions for pivotally connecting the base and the second lever segment.

* * * * *